US006652361B1

(12) United States Patent
Gash et al.

(10) Patent No.: US 6,652,361 B1
(45) Date of Patent: Nov. 25, 2003

(54) ABRASIVES DISTRIBUTION METHOD

(76) Inventors: Ronald Gash, 913 Bodine, Derby, KS (US) 67037; Lester Klingenberg, P.O. Box 153, Andover, KS (US) 67010

( * ) Notice: Subject to any disclaimer, the term of this patent is extended or adjusted under 35 U.S.C. 154(b) by 195 days.

(21) Appl. No.: 09/697,277

(22) Filed: Oct. 26, 2000

(51) Int. Cl.[7] ..... B24B 1/00
(52) U.S. Cl. ..... 451/36; 451/28; 451/60
(58) Field of Search ..... 451/36, 60, 37, 451/28; 705/26, 27, 29, 406

(56) References Cited

U.S. PATENT DOCUMENTS 4,294,357 A * 10/1981 Stevens et al. ..... 206/409
5,676,714 A * 10/1997 Kodate ..... 51/298
6,261,156 B1 * 7/2001 Johnson et al. ..... 451/41
6,378,786 B1 * 4/2002 Beeston et al. ..... 239/333
6,379,225 B1 * 4/2002 Robinson et al. ..... 451/41

OTHER PUBLICATIONS

3M United States, 3M Auto–Pak Quarter sheet Abrasive Assortment, 1995–2002.*
Kisan Hardwares Inc., www.tripeaks.co.kr, 1998–2001.*
Buff Polish & Grind Industrial Supply Co., Inc., www.buffpolishgrind.com, 2000.*
Sait Abrasivi Products, Products, www.sait–abr.com.*
Shopsmith Inc., www.shopsmith.com.*

* cited by examiner

*Primary Examiner*—Timothy V. Eley
(74) *Attorney, Agent, or Firm*—Kenneth H. Jack; Davis & Jack, LLC

(57) ABSTRACT

A method of distributing abrasives to a surface refinisher, who is preparing to engage in refinishing a surface, the surface having a type matching at least one type among a plurality of surface types, the method having steps of arranging abrasives into regressively asperous series so that each series is capable of smoothing at least one of the surface types; packaging the regressively asperous series of abrasives; labeling each package with printed words identifying the surface type the abrasives contained within the package is capable of smoothing; and displaying the packages for selection by the surface refinisher.

7 Claims, 1 Drawing Sheet

ABRASIVES DISTRIBUTION METHOD

FIELD OF THE INVENTION

This invention relates to methods and processes for distributing abrasives to persons engaged in refinishing various types of surfaces.

BACKGROUND OF THE INVENTION

Numerous surface types are capable of being abrasively smoothed to a satin or glossy finish. For example, the steel surface of an automobile fender, along with plastic composite body putty filling dents in the fender, are capable of being abrasively smoothed. Similarly, softer metals such as brass and copper may be smoothed to a satin or gloss finish. Also, resin laminate materials such as fiberglass and graphite composites may be abrasively smoothed to a satin or glossy finish. Likewise, plastic sealed and enameled automobile body finish coats may be smoothed to a satin or glossy finish. Various wooden surfaces from soft pine to mahogany are similarly smoothable. Where such surface types are in need of refinishing, sheets of particulate abrasive laden material are commonly applied thereto in a high frequency orbiting or reciprocating fashion, causing the surface to be scored with a multiplicity of microscopic channels, or "sanded." By utilizing a regressively asperous series of such abrasives sheets, having grit sizes ranging from, for example, F100 to F1500, a dull surface having an average microscopic distance between ridges and valleys of 200 microns (i.e., one-fifth of a millimeter) may be smoothed to a point where the average distance between microscopic ridges and valleys is less than five microns, resulting in a lustrous satin finish or a mirror-like glossy finish. A significant part of the effort involved in utilizing abrasive sheets to progressively smooth a surface is the selection of a proper regressively asperous series of abrasives.

Several variables have an impact upon selection of a proper series of abrasives. The hardness of the surface to be smoothed is a major factor. The particulate matter making up the abrasive must be harder than the surface to be refinished. Another variable is the tendency, if any, of the surface to clog sheet abrasives upon sanding. Other variables are tendencies of the surface to undergo plastic deformation or burnishing; instead of allowing abrasive particles to frangibly cut micro-channels. Unique characteristics of various surface types make it difficult for surface refinishers (i.e., persons engaging in or about to engage in refinishing tasks) to select an appropriate series of abrasives. Where a surface refinisher selects and utilizes an inappropriate series of abrasives in a refinishing task, the surface may be degraded or destroyed instead of being smoothed to a desirable satin or glossy finish.

The instant inventive method efficiently distributes appropriate series of abrasives to surface refinishers for use in various surface refinishing tasks.

BRIEF SUMMARY OF THE INVENTION

The genesis of the abrasives distribution problem solved by the present inventive method is the extreme variety of surface reducing and smoothing abrasives. Common abrasive materials include emery (i.e., a mixture of corundum and iron oxides), garnet, crushed flint, crushed quartz, and pumice or volcanic glass. Harder abrasives include oxides of rare earth metals such as bastnasite, cerite, euxenite, gadolinite, and monazite, and include boron nitride, boron carbide, silicon carbide (i.e., carborundum or alumina), aluminum oxide or corundum, tantalum, and tungsten. Still harder, industrial diamond and synthetic diamond granules are commonly utilized as abrasives. Each of the above listed abrasive types may be sub-categorized according to granule size or coarseness, commonly referred to as the mesh or grit size of the abrasive. According to convention, the mesh or grit size of an abrasive is assigned a number between 40 and 1500, each number having a prescribed range of particle sizes. For example, 94% of the particles of a 120 grit abrasive are larger than 90 microns, and no more than 3% of its particles are larger than 125 microns. At the other end of the spectrum of grit sizes, an abrasive having a 1000 grit has at least 94% of its particles larger than 1 micron, while no more than 3% of its particles are greater than 10 microns. Subdividing the several abrasives according to particle composition and grit size, geometrically increases the abrasive types which might be utilized in a particular refinishing job.

The media upon which abrasive materials are commonly deposited further increases the types of abrasives which are selectable by a surface refinisher. Abrasives may be adhesively deposited upon sheet material such as plastic or paper to form sanding sheets, sanding discs, or sanding belts. Also, abrasives may be deposited upon pads of fibrous mesh commonly referred to as scuff pads. Sponge material may also be utilized. Further, where abrasives are adhesively deposited onto sheet material, the distribution of particles may be "opened coated" or "closed coated;" open coating allowing for space between granules for prevention of clogging of the abrasive sheet.

Taking into account the multitude of abrasive types including all of their subcategory sizes and formats, it can be seen that the number of abrasives which a surface refinisher might select for performing a particular refinishing task is vast. Often, a surface refinisher is unable to select from such vast number of abrasives types an appropriate series of abrasives for performing a particular refinishing task.

According to the present inventive abrasive distribution method, appropriate regressively asperous series of abrasives may be efficiently distributed to surface refinishers who are engaged in or are about to engage in a refinishing project. By executing the arranging, packaging, labeling, displaying, selecting, and distributing steps of the inventive method, surface refinishers are able to quickly and efficiently select and receive distribution of appropriate abrasive series.

Accordingly, a primary object of the present inventive method is the efficient distribution of abrasives to surface refinishers.

Other and further objects, benefits, and advantages of the present invention will become known to those skilled in the art upon review of the Appended Drawing and the Detailed Description which follows.

BRIEF DESCRIPTION OF DRAWING

Drawing

DETAILED DESCRIPTION OF THE PREFERRED EMBODIMENT

Figure 1:
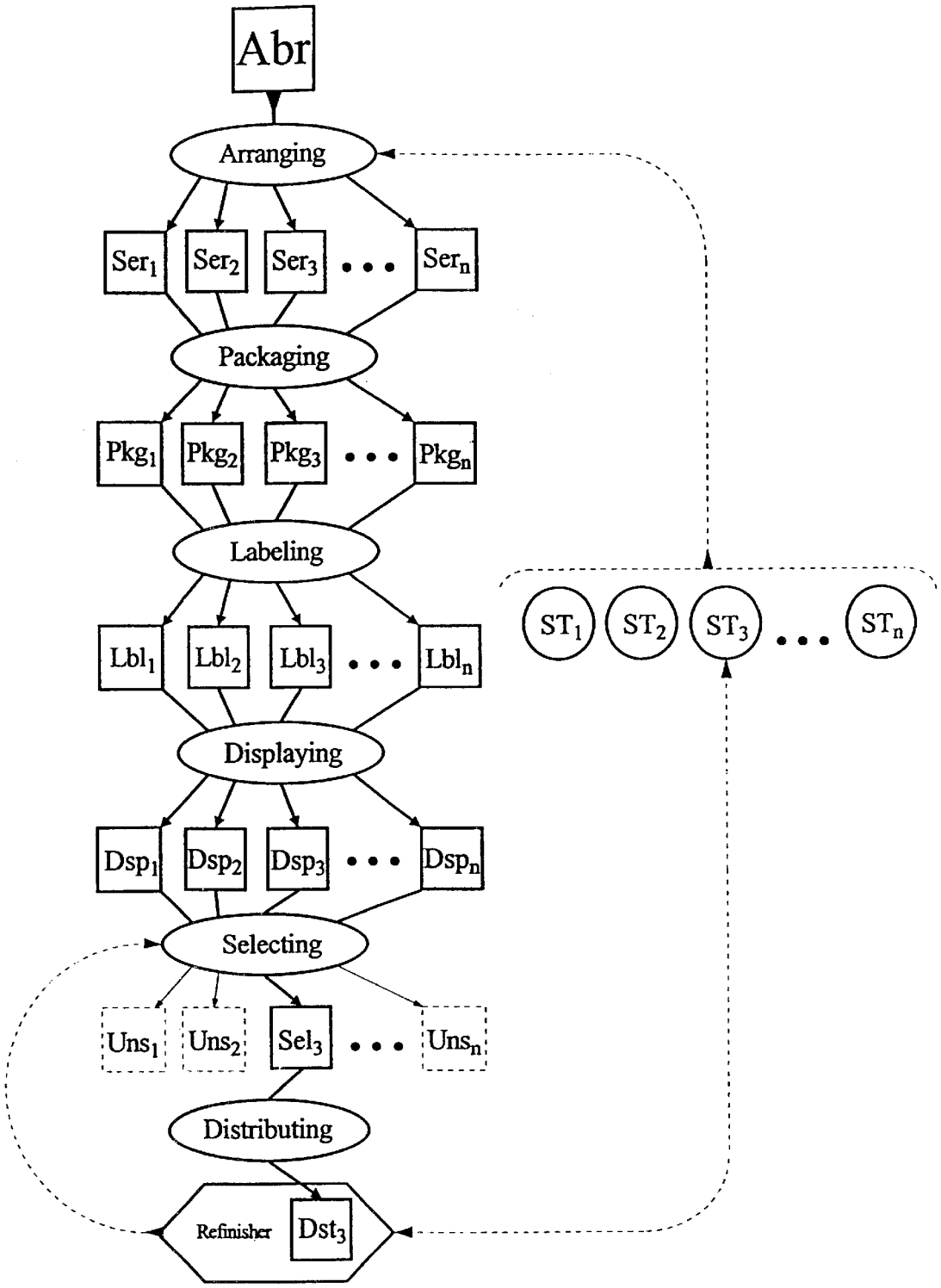
FIG. 1 is a representational flow chart of the instant inventive method.

Referring now to the drawings, and in particular to FIG. 1. Each of the squares represents physical abrasives, while each of ovals represents method steps sequentially applied to the abrasives. Circles represent different surface types. The irregular hexagon at the bottom of the chart represents a surface refinisher (i.e., a person preparing to engage in a surface refinishing task). Solid arrows represent the progression of method steps, and dashed arrows represent a flow of information influencing the method steps.

The uppermost square of the chart, labeled "Abr" represents the universe of types of abrasives, such types being categorizable according to classes of characteristics such as particle composition, particle size, particle distribution, and particle carrying media. Particular particle compositions include emery, garnet, flint, quartz, pumice, bastnasite, cerite, euxenite, gadolinite, monazite, boron nitride, boron carbide, silicon carbide, corundum, tantalum, tungsten, industrial diamond, and synthetic diamond. Common particle sizes range from one micron to one hundred fifty microns. Particle distributions include closed coatings wherein the particles are substantially contiguously deposited, and open coatings wherein spaces exist between the particles, the spaces being equal to or greater than the size of the particles. Abrasive media include flexible plastic or paper sheet material configured as a belt, rectangular sheets, grids or as circular disks. Abrasive media also includes fibrous mesh material, sponges or scuff pads.

The various abrasives making up such universe of abrasive types "Abr" is initially subjected to and arranging step. In performing such step, a plurality of surface types capable of being abrasively smoothed and refinished are identified. In FIG. 1, the plurality of surface types are represented by circles labeled: $ST_1$, $ST_2$, $ST_3$, . . . $ST_n$. For example, $ST_1$ may represent a steel automobile fender, $ST_2$ an acrylic enamel surface, $ST_3$ a urethane surface, and $ST_n$ a hardwood surface. The number of surface types servable by the inventive method is unlimited.

Where the inventive method is directed to such exemplary surface types, the arranging step organizes abrasives selected from the universe of known abrasives into discreet regressively asperous series which are capable of effectively and efficiently smoothing and refinishing the exemplary surface types.

Further referring to FIG. 1, squares labeled $Ser_1$, $Ser_2$, $Ser_3$, . . . $Ser_n$ represent a plurality of regressively asperous series of abrasives, which is the output of the arranging step. Each series preferably is capable of smoothing and refinishing at least one of the surface types among the plurality of exemplary surface types.

For the exemplary surface types referenced above, $Ser_1$ (for refinishing steel) preferably would include one No. 40 grit carborundum grinder disk, four No. 40 grit garnet sanding sheets, four No. 80 grit garnet sanding sheets, four No. 100 grit garnet sanding sheets, and four No. 150 grit garnet sanding sheets; $Ser_2$ (for refinishing acrylic enamel) preferably would include one fibrous mesh pad having 80 grit coarseness, one fibrous mesh pad having 120 grit coarseness, ten 220 grit pumice sheets, four 500 grit pumice sheets, and four 1500 grit pumice sheets; $Ser_3$ (for refinishing a urethane clear coat) preferably includes one fibrous mesh pad having 80 grit coarseness, one fibrous mesh pad having 200 grit coarseness, ten 320 grit garnet sheets, four 500 grit garnet sheets, and four 1500 grit garnet sheets, and $Ser_n$ (for smoothing hardwood surfaces) preferably includes five 100 grit crushed flint sheets, five 150 grit crushed flint sheets, four 180 grit crushed flint sheets, four 220 grit crushed flint sheets, one fibrous mesh pad having 600 grit coarseness embedded therein, and one sponge having 1500 grit pumice embedded thereon. Numerous other regressively asperous series of abrasives adapted for smoothing and refinishing numerous other surface types may be created in the arranging step.

After completion of the arranging step, the progressively asperous series of abrasives are packaged within containers or closures capable of securely storing the abrasives arranged as discreet series. Suitable Closures suitably utilized in the packaging step include flexible transparent bags, transparent bubble or blister packs, transparent shrink wrapping, and cardboard boxes. Referring to FIG. 1, squares labeled $Pkg_1$, $Pkg_2$, $Pkg_3$. . . $Pkg_n$ represent the output of the packaging step; the exemplary regressively asperous series of abrasives being packaged within such closures. Preferably, printed surface refinishing instructions are included within each of the packages.

According to the present inventive method, each of the packages containing the arranged series of progressively asperous abrasives is labeled with printed indicia indicating the surface type the abrasives contained within the package are adapted to refinish. Suitably, such printed indicia may be applied externally to the packaging. Also suitably, such printed indicia may be enclosed within the packaging, viewable externally through transparent elements of the packaging. Referring to FIG. 1, squares labeled $Lbl_1$, $Lbl_2$, $Lbl_3$, . . . $Lbl_n$ represent the output of the labeling step.

The next step under the inventive method comprises displaying the labeled packages of abrasives in a manner allowing surface refinishers to substantially simultaneously view all of the packages along with their print indicia labels. Common display racks having hooks for storing and suspending products may be utilized for such purpose. Alternately, the labeled packages may be displayed on or within shelves, bins, or drawers. Suitably, the display may occur upon the pages of a product order catalog or upon an internet website page. Referring to FIG. 1, squares $Dsp_1$, $Dsp_2$, $Dsp_3$, . . . $Dsp_n$ represent displayed labeled packages of the exemplary abrasive series.

Referring further to FIG. 1, the double headed dashed line arrow represents an intention on the part of the surface refinisher to engage in a particular surface refinishing task. In the example represented by FIG. 1, with the double headed arrow extending between the Surface Refinisher and $ST_3$, (representing the urethane clear coat surface type), the Surface Refinisher intends to refinish that surface type. As indicated by the semi-circular dashed arrow, such intention controls the selecting step. $Sel_1$, $Sel_2$ and $Sel_n$ appearing within dashed line squares represent unselected packages of abrasives, while the square labeled $Sel_3$ represents the selection of the package bearing printed indicia denoting that abrasives capable of refinishing urethane clear coat.

Following the selecting step, the selected package of abrasives is physically conveyed or distributed to the surface refinisher. The final distributing step may be accomplished by the surface refinisher's act of simply grasping and removing the package out of a display rack. Also suitably, a store clerk or a warehouseman may retrieve the package and hand it to the surface refinisher.

Alternately and suitably, where the abrasives are displayed by catalog or internet, distribution may occur via mail or commercial carrier.

Utilization of the inventive distribution method efficiently and accurately distributes abrasives to surface refinishers, avoiding time lost in custom generation of abrasive series, and potentially preventing damage to surfaces in refinishing processes.

While the principles of the inventive method have been made clear in the above illustrative embodiment, those skilled in the art may make modifications in the steps, processes, methods, and procedures of the invention without departing from those principles. Accordingly, it is intended that the description and drawings be interpreted as illustrative and not in the limiting sense, and that the invention be given a scope commensurate with the appended claims.

We claim:

1. A method of distributing abrasives to a surface refinisher, the surface refinisher preparing to engage in refinishing a surface, the surface having a type matching at least one type among a plurality of surface types, the method comprising the steps of:

(a) arranging abrasives into a plurality of regressively asperous series so that each series among said plurality is capable of smoothing at least one surface type among the plurality of surface types;

(b) packaging within a plurality of packages the regressively asperous series of abrasives so that each package among the plurality of packages contains at least one of said series;

(c) labeling each package among the plurality of packages with print indicia identifying the at least one surface type the at least one regressively asperous series of abrasives contained therein is capable of smoothing; and, (d) displaying the packages for selection by the surface refinisher.

2. The method of claim 1 further comprising the step of selecting for use by the surface refinisher at least one of the packages in accordance with the surface to be refinished.

3. The method of claim 2 further comprising the step of conveying to the surface refinisher the selected package.

4. The method of claim 3 wherein the arranging step comprises a step of selecting abrasives from the group consisting of emery, garnet, flint, quartz, pumice, steatite, boron, nitride, boron carbide, silicon carbide, alumina, tantalum, tungsten, bastnasite, cerite, euxenite, gadolinite, monazite, fibrous mesh pads, industrial diamonds, and synthetic diamonds.

5. The method of claim 4 wherein the packaging step comprises a step of selecting a packaging material from the group consisting of boxes, plastic blister packs, plastic shrink wrap, bags and sacks.

6. The method of claim 5, further comprising the step of enclosing within each package printed refinishing instructions.

7. The method of claim 4 wherein the displaying and selecting steps are executed via computer internet communication, and where the conveying step comprises a step of shipping the selected package to the surface refinisher.

* * * * *